US006569218B2

(12) United States Patent
Dudley

(10) Patent No.: US 6,569,218 B2
(45) Date of Patent: May 27, 2003

(54) SELF SPIN-CLEANING CANISTER VACUUM

(76) Inventor: David Edmond Dudley, 2673 Million Ct., San Jose, CA (US) 95148

( * ) Notice: Subject to any disclaimer, the term of this patent is extended or adjusted under 35 U.S.C. 154(b) by 0 days.

(21) Appl. No.: 09/802,166

(22) Filed: Mar. 8, 2001

(65) Prior Publication Data

US 2002/0124729 A1 Sep. 12, 2002

(51) Int. Cl.[7] ..... B01D 46/04

(52) U.S. Cl. ..... 55/385.1; 55/282; 55/283; 55/291; 55/293; 55/302; 55/304; 55/305; 55/467; 55/521; 55/DIG. 3; 95/278; 95/279; 15/352

(58) Field of Search ..... 55/282, 283, 291, 55/293, 302, 304, 305, 385.1, DIG. 3, DIG. 8, 467, 521; 95/278, 279, 282; 15/345, 352

(56) References Cited

U.S. PATENT DOCUMENTS 3,008,543 A * 11/1961 Bourdalé et al. ..... 55/283
3,778,982 A * 12/1973 Birke ..... 55/302
3,888,643 A * 6/1975 Yoshikawa et al. ..... 15/352
3,890,114 A * 6/1975 Bovensiepen ..... 30/457
3,998,656 A * 12/1976 Grotto ..... 15/304
4,130,404 A * 12/1978 Bergdahl ..... 55/291
4,222,755 A * 9/1980 Grotto ..... 55/291
4,285,704 A * 8/1981 Zuzanov et al. ..... 55/291
4,689,143 A * 8/1987 Miers ..... 55/290
4,808,234 A * 2/1989 McKay et al. ..... 15/345
4,885,009 A * 12/1989 Schneider ..... 55/291
5,989,419 A * 11/1999 Dudley et al. ..... 134/138
6,156,213 A * 12/2000 Dudley et al. ..... 134/138

* cited by examiner

*Primary Examiner*—Duane Smith
*Assistant Examiner*—Jason M. Greene
(74) *Attorney, Agent, or Firm*—Richard B. Main

(57) ABSTRACT

A method of using vacuum-cleaner filters includes mounting a cylindrical-shaped filter cartridge coaxially on a rotatable spindle. Then air is drawn radially through a filter material wall of the filter cartridge. Periodically, the cartridge filter on the spindle is spun to dislodge any debris entrapped in the filter material by centrifugal force. Air flow is selectively drawn or pushed radially through a filter material wall of the filter cartridge. A clutch disposed between a motor and the spindle is used to periodically spin the cartridge filter on the spindle to dislodge any debris entrapped in the filter material by centrifugal force. Preferably, a motor that can be run in either a forward direction or a reverse direction is used.

6 Claims, 3 Drawing Sheets

204
200
A1
L1
AC power
reverse
motor
A2
L1
208
F1
212
cntltr
206
214
210
F2
202
217
pump
216
220
engaged
clutch
222
218

204
200
A1
L1
AC power
A2
L1
forward
motor
208
F1
212
cntlr
206
214
210
F2
202
217
pump
216
220
disengaged
clutch
222
218
stopped

SELF SPIN-CLEANING CANISTER VACUUM

BACKGROUND OF THE INVENTION

1. Field of the Invention

The present invention relates to vacuum cleaners, and more particularly to canister vacuum cleaners with cartridge filters that need occasional cleaning.

2. Description of Related Art

The familiar canister vacuum cleaner, or shop vac, is a common appliance in many American homes and workshops. The most popular designs place a vacuum pump and electrical motor on top of a canister lid. A cartridge filter is held underneath the lid and the vacuum pump draws air through the filter and out to an exhaust. The whole assembly on the lid is then latched to the top of a canister bucket and a vacuum hose is attached to the side. Any debris that is drawn in through the hose drops inside the bucket and is prevented from passing through by the cartridge filter.

Fine particles which are not heavy enough to drop to the bottom of the bucket will lodge and cake on the filter. Such filters are typically made of pleated paper and a lot of the sweepings will trap between the pleats. The paper matrix itself will also clog. So, over time, the cartridge filter will eventually become so clogged that no vacuum air can be drawn through.

Users typically dump the contents of the canister bucket and shake the loose material out of the cartridge filter. This can be very messy and the filter does not really come very clean. Thus the filter cartridges need to be replaced frequently. Some users simply replace the filter on every cleaning to avoid the mess associated with beating or shaking the old filters free of dirt.

The present inventor, David E. Dudley, describes the cleaning of water filter cartridges in two previous patents by spinning the filter cartridges to take advantage of centrifugal force. U.S. Pat. No. 5,989,419, issued Nov. 23, 1999, describes a spinner on which a dirty, removable pool filter can be mounted. A water jet from a hose is directed at the filter and it will spin on its own on the axle provided. The combination of the water jet and spinning of the filter causes filter cake to be washed and flung free. U.S. Pat. No. 6,156,213, issued Dec. 5, 2000, describes an in-situ spin-clean water filter. An enclosed filter is mounted on a pivot so it can easily spin but not allow internal water-bypass leakage. Strategically placed water jets inside can be turned on to cause the filter to be spun, e.g., after the enclosure has been drained. Both such Patents are incorporated herein by reference.

SUMMARY OF THE INVENTION

Briefly, a method embodiment of the present invention comprises mounting a cylindrical-shaped filter cartridge coaxially on a rotatable spindle. Air is then drawn radially through a filter material wall of the filter cartridge during normal operation, as in a vacuum cleaner. Periodically, the cartridge filter on the spindle is spun to dislodge any debris entrapped in the filter material by centrifugal force. An air flow control can be included to selectively draw or push air radially through a filter material wall of the filter cartridge. A clutch disposed between a motor and the spindle may be used to spin the cartridge filter.

An advantage of the present invention is a shop vac is provided that can be easily cleaned.

Another advantage of the present invention is that a filter system is provided that allows filter cartridges to be reused.

A still further advantage of the present invention is that a method is provided for automatically maintaining a vacuum cleaning system.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1:
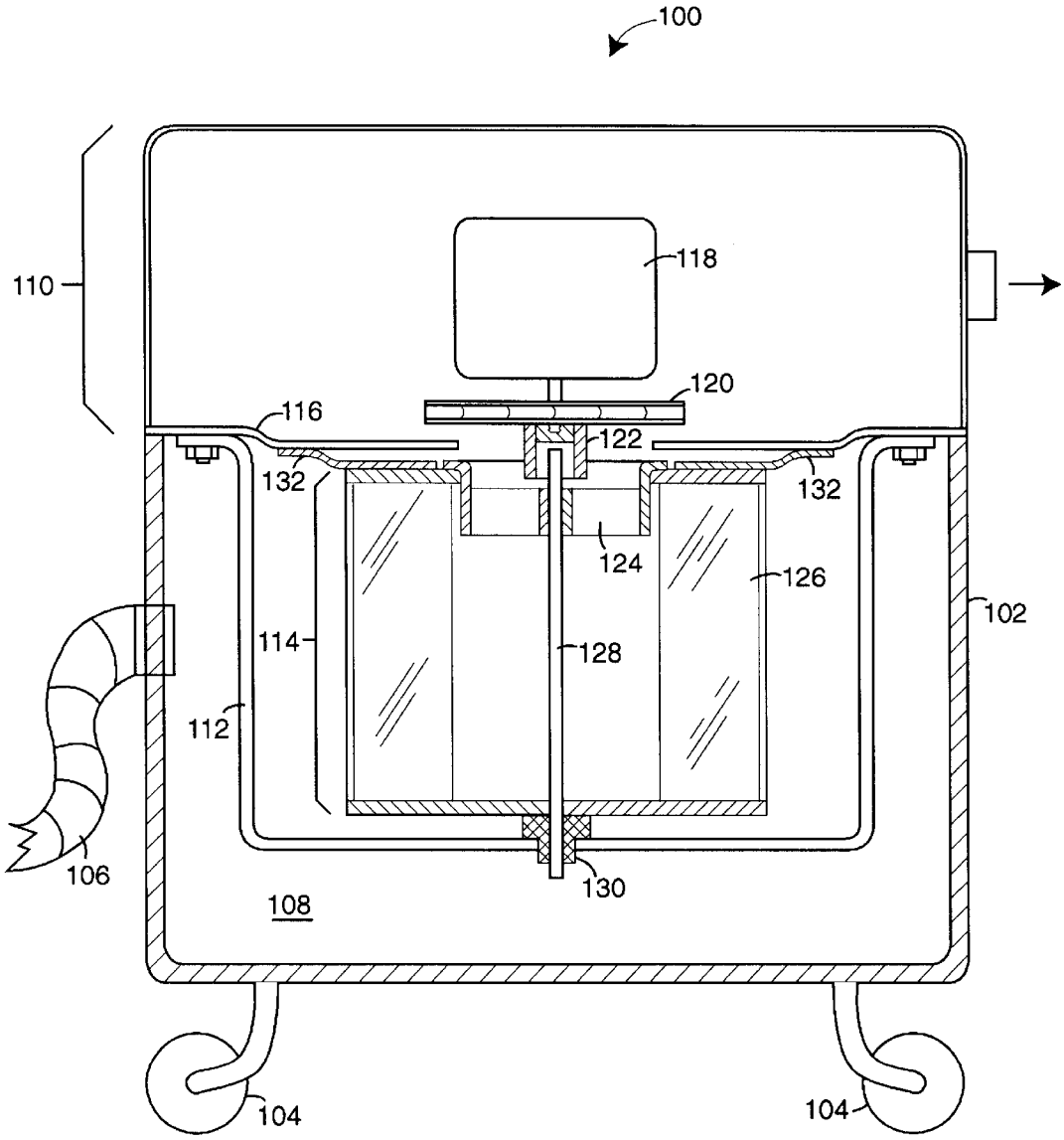
FIG. 1 is a cross-sectional diagram of a shop vac embodiment of the present invention.

FIG. 1 represents a vacuum-cleaning system embodiment of the present invention, and is referred to herein by the general reference numeral 100. The vacuum-cleaning system 100 is typically constructed with a canister 102 in the form of a large pail or bucket and is made of plastic or metal. A set of caster wheels 104 are attached for convenience so the unit can be pulled around easily on the floor. A vacuum hose 106 leads into an inner debris chamber 108. Dirt, debris, and other sweepings are drawn in through the hose 106 during operation and drop to the inside bottom of the canister 102.

A removable assembly 110 includes a frame 112 and a filter assembly 114. Such removable assembly 110 is clipped to the canister 102 and can be removed to dump out the debris inside. A platform 116 provides the mounting support for the frame 112, filter assembly 114, and an electric motor 118. A vacuum impeller 120 and a one-way clutch 122 are both driven by the motor 118. A hub 124 is pressed inside one end of a standard filter cartridge 126 and both are fixed on a spindle 128. A lower spindle bearing 130 attaches to the frame 112 for support. A flap gasket 132 in the form of a large wide flat O-ring is attached to the top end of the filter cartridge 126 and seals against platform 116 during normal vacuuming use.

However, during a filter-cleaning mode, the flap gasket 132 will slide against platform 116 when the filter assembly is spinning. Such spinning occurs when the motor 118 drives in reverse to engage the one-way clutch 122.

In normal operation as a vacuum cleaner, the one-way clutch 122 is disengaged, the motor 118 is driving forward at full power, and air flow is in through the hose 106. The filter assembly 114 is preferably stopped or locked from turning.

In periodic operation in the filter-cleaning mode, the one-way clutch 122 will be engaged when the motor 118 is driving in reverse. Such motor operation is preferably at reduced power, and air flow is back out through the hose 106. A minimum motor power level is required so the filter assembly 114 spins fast enough to fling off entrapped debris and filter cake. Any reverse air flow from the vacuum impeller 120 assists in this filter-cleaning action. After a short time in this mode, the removable assembly 110 can be lifted off and the canister 102 dumped.

Figure 2A:
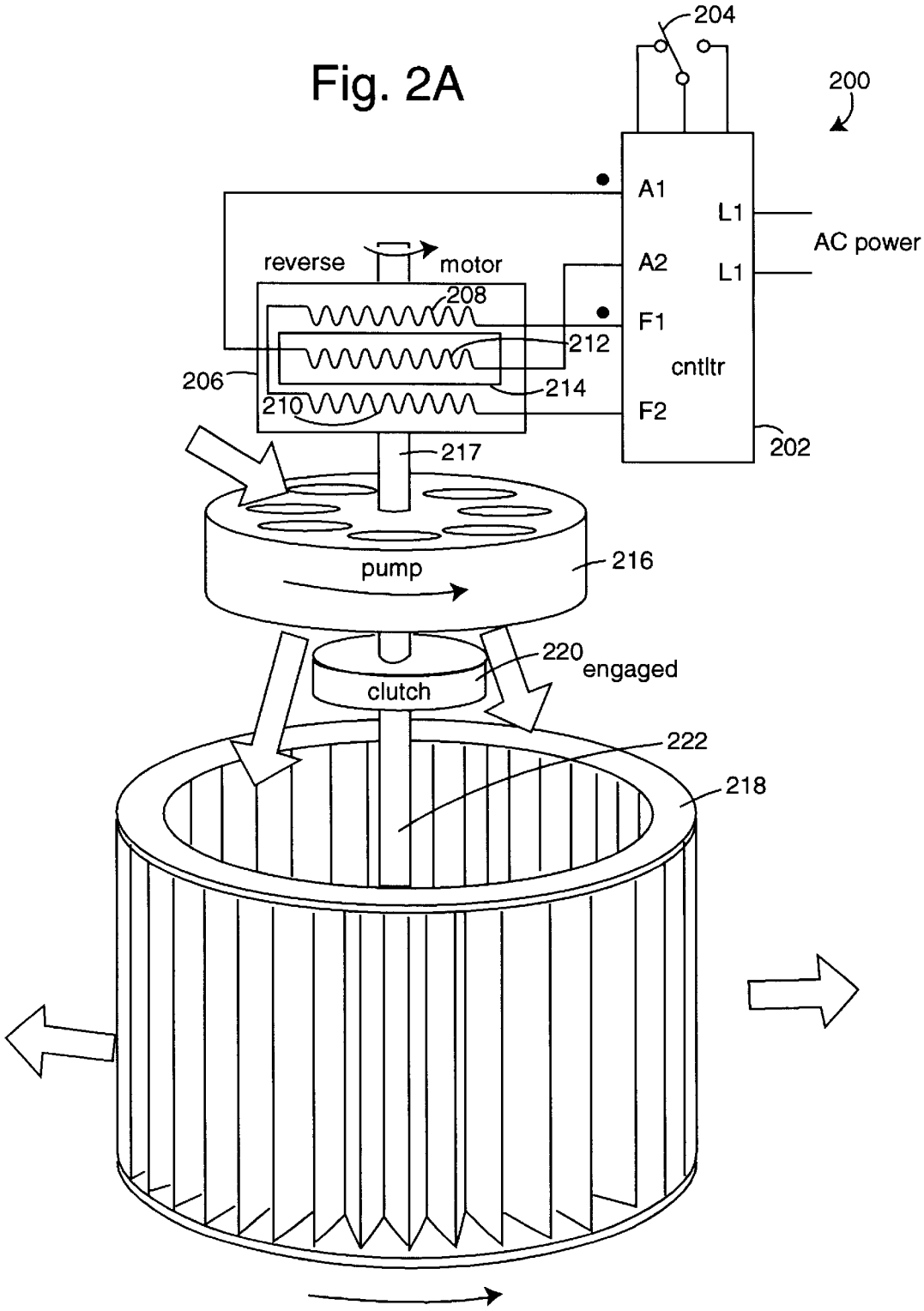
FIG. 2A is a side-view and schematic diagram of a filter assembly useful in the shop vac of FIG. 1, and is shown in the filter cartridge spinning and maintenance mode.
Figure 2B:
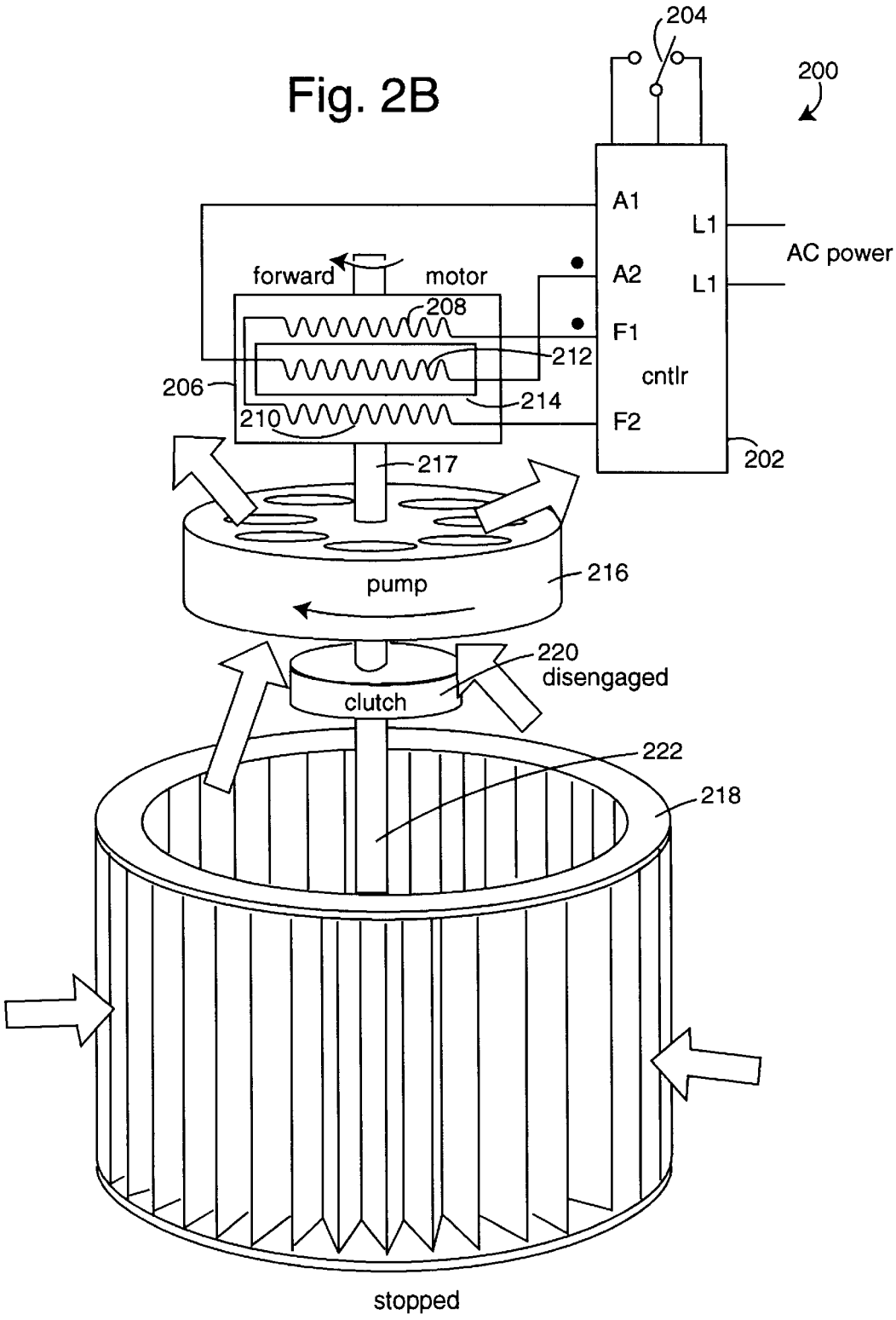
FIG. 2B is also a side-view and schematic diagram of a filter assembly useful in the shop vac of FIG. 1, and represents the system in its normal vacuum cleaning mode wherein the filter cartridge does not spin.

FIGS. 2A and 2B show a removable vacuum assembly 200 like that included in FIG. 1. An electrical power controller 202 is equipped with a "run-off-service" switch 204. Such is shown in the "service" position in FIG. 2A. A motor 206 is equipped with a pair of field windings 208 and 210. These encircle an armature winding 212 wound on a free-rotating armature 214. The controller 202 is configured to provide combinations of power phase and power levels to the motor windings that will spin the armature at half power in reverse when the switch is in the service position.

The controller 202 also provides combinations of power phase and power levels to the motor windings that will spin the armature forward at full power when the switch is in the "run" position.

The removable vacuum assembly 200 further comprises a pump 216 which is driven by a motor shaft 217. Such pump is primarily arranged to draw air to create a strong vacuum cleaning pull through a filter 218, as in FIG. 2B. FIG. 2A shows the motor 206 and pump 216 turning in such a direction as to pump air in reverse, as indicated by the large arrows in the drawing. The filter 218 is in the general form of a cylinder with walls of pleated, porous paper or other filter material, and is coaxial with the motor shaft 217.

A clutch 220 is engaged in the mode illustrated by FIG. 2A such that motor power is coupled through to a spindle 222. The filter 218 is coaxially connected to the spindle 222 and it will turn too. The spin created is preferably fast enough to generate a centrifugal force in the filter sufficient to clean the pores and pleats of its material, especially as aided by the reverse air flow. The clutch 220 can be implemented in a number of different ways. First, a one-way type of automatic clutch can be used that locks in one direction of turning, and free-wheels in the other. This type was common in automobile overdrive transmissions.

A second type of clutch that can be used is an electromechanical type, e.g., as is common in automobile air-conditioning compressors. An electromagnet is used to draw in clutch shoes that engage by spring action. Such electromagnet coil could be switched into series connection with the motor when reverse, lower power operation is desired for a filter maintenance cycle. A third type of clutch is one in which the clutch is manually engaged and disengaged, as in a gearbox with a neutral. Other types of clutches will no doubt be useful in embodiments of the present invention.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A vacuum-cleaning system, comprising:

an electric, reversible motor connected to drive a motor shaft in either a forward or a reverse rotation;

an air pump connected to be driven by the motor and that provides for a forced air flow in opposite directions depending on the forward or reverse rotation of the motor;

a one-way clutch connected to the motor shaft and having a spindle output-shaft that is engaged and disengaged depending on the forward or reverse rotation of the motor; and a pleated cylindrical filter cartridge coaxially disposed on and attached to said spindle output-shaft to spin at the urging of the motor when the clutch is engaged, and further disposed in a reversible airflow path of the air pump;

wherein, the filter cartridge does not spin substantially during operation of the motor in said forward direction with the clutch disengaged and provides for a removal of particles from said reversible airflow path; and wherein, the filter cartridge will spin to clean itself by centrifugal action during operation of the motor in said reverse direction with the clutch engaged.

2. The vacuum-cleaning system of claim 1, further comprising:

a motor controller connected to the motor and able to switchably provide operation of the motor in either of said forward and reverse directions.

3. The vacuum-cleaning system of claim 1, further comprising:

a mechanical one-way mechanism disposed in the clutch and providing automatic clutch engagement in said reverse direction and free-wheeling in said forward direction;

wherein, the filter cartridge does not spin when the clutch is free-wheeling.

4. The vacuum-cleaning system of claim 1, further comprising:

a mechanical mechanism disposed in the clutch and providing for manual engagement by a user and that is concurrent with the motor operating in said reverse direction.

5. The vacuum-cleaning system of claim 1, further comprising:

an electromechanical mechanism disposed in the clutch and providing for electrically controlled clutch engagement.

6. The vacuum-cleaning system of claim 1, further comprising:

an electromechanical clutch mechanism disposed in the clutch and providing for electrically controlled clutch engagement; and a motor controller connected to the motor and the electromechanical clutch mechanism, and able to switchably provide operation of the motor in either of said forward and reverse directions with automatic engagement of the clutch for a filter-cleaning mode of operation.

* * * * *